US006036248A

United States Patent [19]

Fänger et al.

[11] Patent Number: 6,036,248

[45] Date of Patent: Mar. 14, 2000

[54] LOAD-SUPPORTING APPARATUS FOR LOADS PROVIDED WITH A PICK-UP EYELET

[75] Inventors: Alfred Fänger, Wetter; Udo Gersemsky, Herdecke; Ralf Eising, Herne, all of Germany

[73] Assignee: Mannesmann AG, Düsseldorf, Germany

[21] Appl. No.: 09/240,394

[22] Filed: Jan. 29, 1999

[30] Foreign Application Priority Data

Jan. 30, 1998 [DE] Germany ..... 198 04 850

[51] Int. Cl.[7] ..... B66C 1/34

[52] U.S. Cl. ..... 294/82.31; 294/82.34; 294/110.1

[58] Field of Search ..... 294/82.15, 82.17, 294/82.23, 82.31, 82.33, 82.34, 81.56, 110.1; 24/598.4, 598.7, 600.4, 600.5, 600.6, 600.7, 600.8

[56] References Cited

U.S. PATENT DOCUMENTS

| | | | |
|---|---|---|---|
| 1,368,647 | 2/1921 | Myers | 294/82.33 |
| 3,167,345 | 1/1965 | Dukes | 294/82.31 |
| 3,311,401 | 3/1967 | Bacon | 294/110.1 |
| 3,625,558 | 12/1971 | Johnson | 294/110.1 |
| 3,964,777 | 6/1976 | Lindqvist | 294/82.31 |
| 4,026,594 | 5/1977 | Kumpulainen | 294/82.33 |
| 4,149,746 | 4/1979 | Androski | 294/82.31 |
| 4,609,219 | 9/1986 | Go | 294/82.33 |

FOREIGN PATENT DOCUMENTS 32 13 693 C1 10/1983 Germany .

*Primary Examiner*—Dean J. Kramer
*Attorney, Agent, or Firm*—Henry M. Feiereisen

[57] ABSTRACT

A load-supporting apparatus, includes a housing, a load hook defining a throat area and swingably mounted in the housing for rotation in a vertical plane between a locked stand-by position in which the load hook is disengaged from a pick-up eyelet of a load and a locked load-receiving position in which the load hook engages the pick-up eyelet of the load. Operatively connected to the load hook is a centering unit for effecting a rotation of the load-bearing between the stand-by and load-receiving positions when the centering unit encounters a resistance, with the centering unit closing off the throat area of the load hook after swinging of the load hook into the load-receiving position.

16 Claims, 3 Drawing Sheets

LOAD-SUPPORTING APPARATUS FOR LOADS PROVIDED WITH A PICK-UP EYELET

CROSS-REFERENCES TO RELATED APPLICATIONS

This application claims the priority of German Patent Application Serial No. 198 04 850.5, filed Jan. 30, 1998, the subject matter of which is incorporated herein by reference.

BACKGROUND OF THE INVENTION

The present invention relates, in general, to a load-supporting apparatus for loads provided with a pick-up eyelet, and in particular to a load-supporting apparatus of a type including a load hook swingably mounted for rotation in a vertical plane between a locked stand-by position in which the load hook is disengaged from the pick-up eyelet of the load and a locked load-receiving position in which the load hook engages the pick-up eyelet of the load.

German Pat. No. DE 32 13 693 C1 discloses a load-supporting apparatus with a load hook which is swingably supported for rotation about a horizontal axis in an actuating unit, whereby the pivot axis with the load hook and a housing are movably guided for displacement in a vertical direction in the actuating unit. Mounted to the actuating unit is a control pin for effecting a rotation of the load hook and operation of a locking mechanism for interlocking the actuating unit with the housing after each second placement, i.e. encounter of a resistance. The rotation of the load hook is initiated when the actuating unit encounters a resistance, e.g. is placed upon the load being lifted, whereby the actuating unit realizes at the same time a centering of the load hook. Thus, upon encountering a resistance, the locking mechanism is released and the load hook can pivot, for example, into the load-receiving position for engaging a pick-up eyelet of the load when previously occupying the outwardly swung stand-by position.

This conventional load-supporting apparatus has the drawback that operating errors may cause a situation in which the eyelet is grabbed by the pointed end of the load hook. This may result in a drop of the load. Furthermore, as the actuating unit is situated on one side of the load hook, the incorporation of counterweights becomes necessary, leading to undesired stress and associated increased wear of the load-supporting apparatus. Also, a dismantling of the load-supporting apparatus becomes very complicated.

SUMMARY OF THE INVENTION

It is thus an object of the present invention to provide an improved load-supporting apparatus, obviating the afore-stated drawbacks.

In particular, it is an object of the present invention to provide an improved load-supporting apparatus which is so constructed as to eliminate any possibility of operational errors resulting in a grabbing of a load by the pointed end of the load hook.

These objects, and others which will become apparent hereinafter, are attained in accordance with the present invention by providing a load hook which defines a throat area and is swingably mounted for rotation in a vertical plane between a locked stand-by position in which the load hook is disengaged from a pick-up eyelet of a load and a locked load-receiving position in which the load hook engages the pick-up eyelet of the load, and a centering unit which is operatively connected to the load hook for effecting a rotation of the load hook between the stand-by and load-receiving positions when the centering unit encounters a resistance, with the centering unit closing off the throat area of the load hook after rotation of the load hook into the load-receiving position.

Through the provision of a centering unit in accordance with the invention, the throat area of the load hook is closed off after the load hook is pivoted for engagement with the eyelet, so that the load cannot be grabbed by the pointed end of the load hook as a result of an improper operation of the apparatus. Thus, the load hook forms in conjunction with those components of the centering unit that close off the throat area a closed eyelet. A further advantage of the present invention is the symmetric configuration of the load-receiving apparatus so that the need for additional counter-weights is eliminated.

A closing of the throat area of the load hook can easily be realized by using the centering unit to cover the pointed end of the load hook as the centering unit is positioned directly opposite to the pointed hook end. Thus, the centering unit, in effect, assumes a dual task, namely centering of the load hook and covering the pointed hook end. Suitably, a closing of the throat area of the load hook is simply effected by a form-fitting engagement of the pointed hook end in a recess of the centering unit when the load hook is in the load-receiving position.

According to another feature of the present invention, the centering unit may include a slide element which is so constructed as to form the recess for interaction with the pointed end of the load hook. In addition, the centering unit is provided with a centering frame, with the slide element being supported in a housing of the load-supporting apparatus for movement in a vertical direction and having a lower end which carries the centering frame.

According to still another feature of the present invention, the load hook is linked to the centering unit by a pivot lever which is so articulated at one end to the slide element and at the other end to the shank portion of the load hook that a vertical displacement of the slide element is translated into a rotation of the load hook. In this manner, a proper swinging motion of the load hook, in particular for engaging the pick-up eyelet for grabbing the load, is ensured.

Suitably, the pointed end of the load hook is forced into engagement on the slide element in the load-receiving position by the own weight of the slide element, so that there is no need for additional means.

To ensure a precise locking and unlocking operation of the load hook, locking and unlocking is controllable in dependence on a relative position of the slide element within the housing of the load-supporting apparatus.

Preferably, the load hook swings alternately between the stand-by and load-receiving positions to realize a correct grabbing and correct placement of the load. The alternating sequence of locking and unlocking is thereby realized in a simple manner by providing a locking slotted-link mechanism for guiding the rotation of the load hook.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
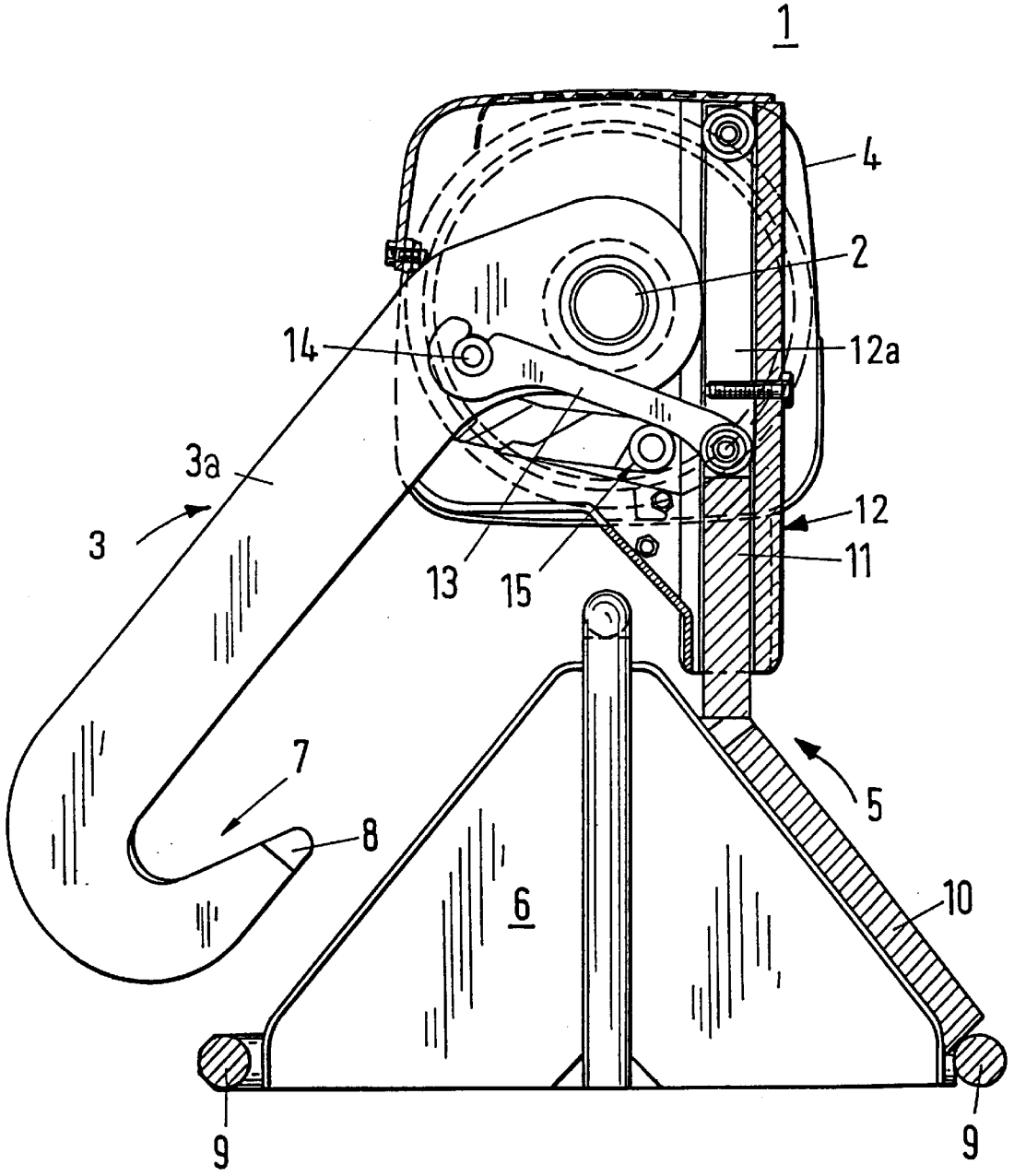
FIG. 1 is a cross sectional view of a load-supporting apparatus according to the present invention in stand-by position, with the load hook being outwardly pivoted.

Throughout all the Figures, same or corresponding elements are generally indicated by same reference numerals.

Turning now to the drawing, and in particular to FIG. 1, there is shown a cross sectional view of a load-supporting apparatus according to the present invention, generally designated by reference numeral 1 for elevating, supporting and transporting a load. The load-supporting apparatus 1 includes a load hook 3, generally designated by reference numeral 3 and swingably mounted in a housing 4 for rotation about a horizontal pivot axis 2. The load hook 3 has a shank portion 3*a* which terminates in a pointed hook end 8 by which a throat area 7 is defined. The load hook 3 interacts with a centering unit 5 which ensures automatic centering of the load-supporting apparatus 1 when placed on a pick-up eyelet 6 for a load (not shown), whereby the eyelet 6 is so designed as to complement the outer contour of the centering unit 5.

Figure 2:
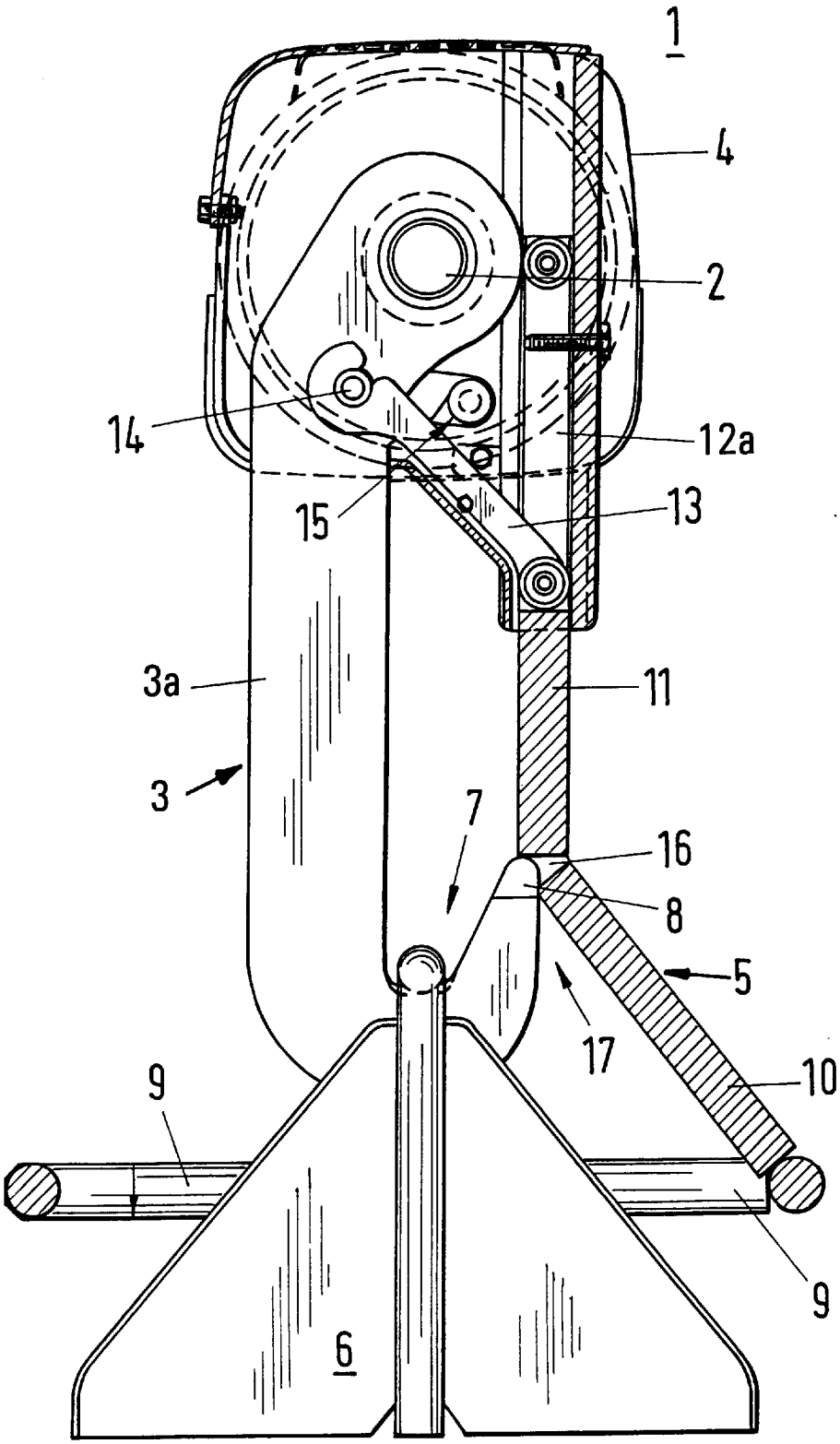
FIG. 2 is a cross sectional view of the load-supporting apparatus FIG. 1 in load-receiving position, with the load hook being inwardly pivoted.

The centering unit 5 includes a centering frame 9 which is connected to one end of a slantingly extending coupling element 10. The other end of the coupling element 10 is connected to a vertical slide element 11 which is received in a track 12*a* formed in a vertical guide 12 of the housing 4. The slide element 11 is guided for movement in vertical direction inside the track 12*a* by rollers (not shown) so that the frame 9 reciprocates in precisely perpendicular direction with respect to the housing 4. Therefore, the pivot axis 2 is situated in vertical alignment above the eyelet 6 when a load is suspended from the eyelet 6. As shown in FIGS. 1 and 2, the slide element 11 and the coupling element 10 are angled relative to one another, i.e. the coupling element 10 is angled toward the outside with respect to the vertical slide element 11. As a consequence of the angled relationship, a recess 16 is formed at the junction between the coupling element 10 and the slide element 11 for engagement by the hook end 8, as will be described furtherbelow.

The interaction between the load hook 3 and the centering unit 5 is realized by a pivot lever 13 which has one end rotatably supported at the coupling element distal end of the slide element 11, and another end which is rotatably supported in proximity of the pivot axis 2 to the shank portion 3*a* of the load hook 3 via a bolt 14 which is received in a locking slotted-link mechanism 15 formed in the housing 4. The slotted-link mechanism 15 is configured as circular slotted guide, i.e. the bolt 14 slides in an endless slot along a closed curve without changing its direction of movement. The interaction between the load hook 3 and the centering unit 5 upon encountering a resistance is realized via the pivot lever 13 which also prevents an uncontrolled swinging of the load hook 3. The arrangement of the bearing points of the pivot lever 13 is so selected that the hook 3 swings outwards when the slide element 11 shifts upwardly in the track 12*a*, and swings inwards for grasping the eyelet 6 when the slide element 11 shifts downwards. Suitably, the pivot lever 13 is supported at the bearing points by a bearing bushing which can be easily displaced if dismantling of the load-supporting apparatus 1 is intended.

The slotted-link mechanism 15 is also configured in such a way that the load hook 3 automatically locks in two positions of the bolt 14 during its travel within the circular slot, whereby initially, when the frame 9 of the centering unit 5 encounters a resistance, the locking action is released and upon further encountering a resistance the load hook 3 is pivoted from one of the stand-by and load-receiving positions into the other one of the stand-by and load-receiving positions and is automatically locked there.

Figure 3:
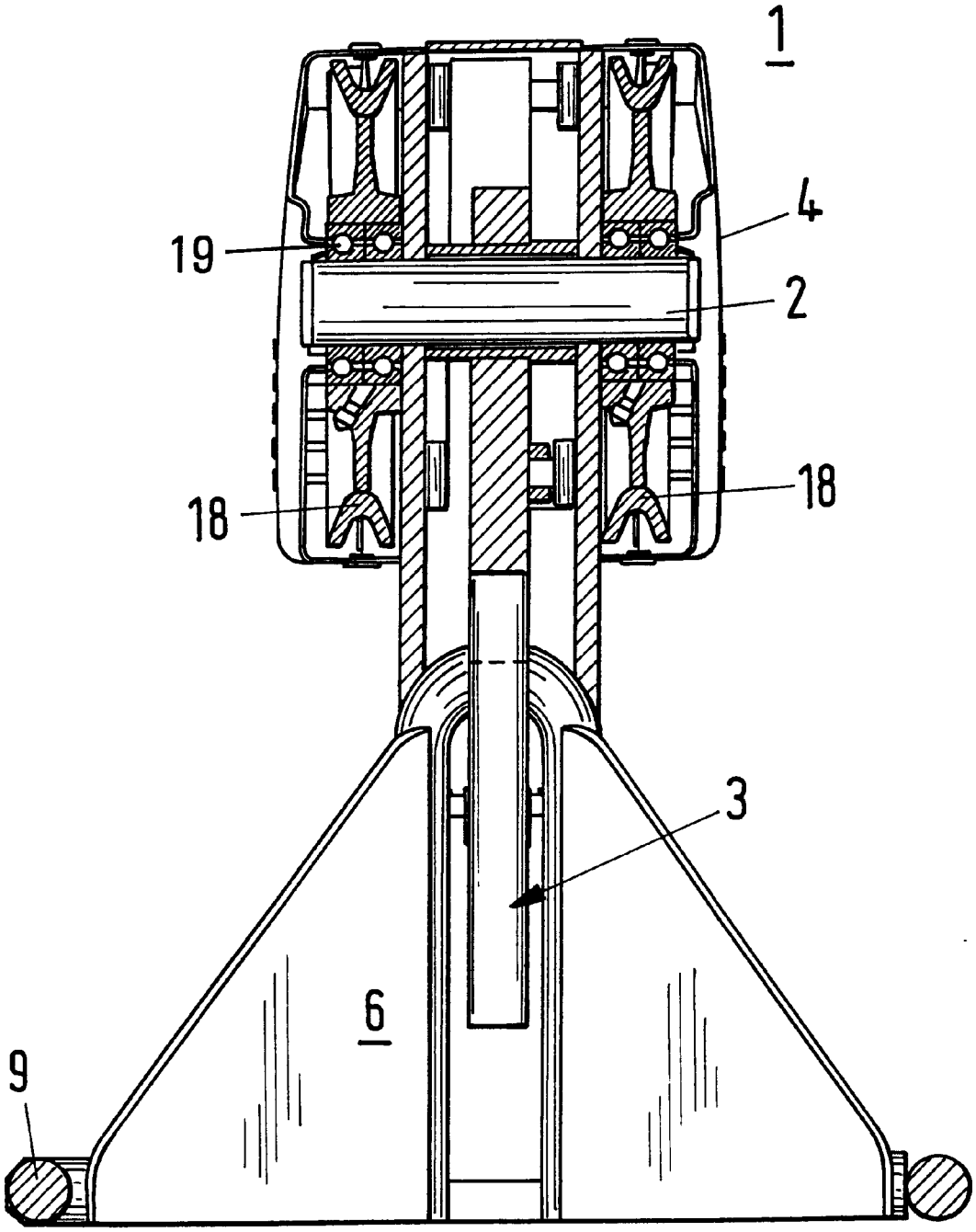
FIG. 3 is a sectional view of the load-supporting apparatus of FIG. 1 in 90° rotated position.

As shown in particular in FIG. 3, the housing 4 accommodates two pulleys 18 in symmetric disposition with respect to the pivot plane of the hook 3. The pulleys 18 are rotatably supported by bearings 19 for rotation about the pivot axis 2. It will be appreciated by persons skilled in the art that the load-supporting apparatus 1 is shown in the drawing only by way of its lower block and must contain much mechanical components which do not appear in the foregoing Figures, e.g. ropes trained around the pulleys 18, or drives for lengthening and shortening the ropes to realize a lowering or lifting of the housing 4. However, these components, like much other necessary components, are not part of the invention, and have been omitted from the Figures for the sake of simplicity.

The mode of operation of the load-supporting apparatus is as follows: FIG. 1 shows the load hook 3 in the locked stand-by position in which the load hook 3 is swung outwards to a location alongside of the eyelet 6, and FIG. 2 shows the load hook 3 in the locked load-receiving position in which the load hook 3 is swung inwardly to grasp the eyelet 6 and thereby holds the load. Initiation of the swinging motion of the load hook 3 from one of the stand-by and load-receiving positions into the other one of the stand-by and load-receiving positions in a vertical plane, as can be seen from FIGS. 1 and 2, is effected by the centering unit 5 when encountering a resistance and as a consequence of the interconnection between the centering unit 5 and the load hook 3 via the pivot lever 13.

When lowering the load carried by the load hook 3 for placement on a suitable location, the load-supporting apparatus 1 automatically centers itself via the frame 9 with respect to the eyelet 6. Upon placement of the load-supporting apparatus 1, the housing 4 slides by its own weight into a lower end position. Only then does the load hook 3 swing outwards by means of the pivot lever 13, with the bolt 14 sliding within the slotted guide 15 into a locked position. When lifting the load-supporting apparatus 1, the housing 4 slides at first upwards, whereby the load hook 3 slightly swings inwardly. Locking of the load hook 3 is realized in this position. At renewed impact of the frame 9 of the centering unit 5 on a resistance, e.g. the eyelet 6, the load hook 3 is first pivoted slightly outwards, thereby releasing the locked position of the bolt 14. Continued lifting of the load-supporting apparatus 1 then causes the housing 4 to slide again into the upper end position while the load hook 3 now swings inwardly to grasp the eyelet 6. As shown in particular in FIG. 2, the recess 16 formed in the transition zone between the slide element 11 and the coupling element 10 is so configured that the hook end 8 abuts against a confronting horizontal surface of the slide element 11 and is urged in the load-receiving position of the load hook 3 into forced engagement with the slide element 11 by the own weight of the centering unit 5.

As further shown in FIG. 2, the centering unit 5 is so configured that components thereof seal or close off the throat area 7 of the load hook 3 after the load hook 3 pivots inwardly, as a result of the pointed hook end 8 being covered in the load-receiving position of the load hook 3 by the directly opposite centering unit 5, whereby the hook end 8 engages in form-fitting manner in the recess 16 of the centering unit 5.

The roller-type guidance of the slide element 11 ensures a smooth traveling thereof in the track 12*a*, so that the release of the locked position of the bolt 14 and thus of the load hook 3 can conceivably be released also manually.

As further shown in FIG. 2, the load hook 3 and the coupling element 10 demarcate together in the load-receiving position of the load hook 3 a wedge-shaped opening 17 which is so selected that, even when the load hook 3 is closed and thus occupies the load-receiving position, it is possible to grasp the eyelet 6. Thus, in the event the load hook 3 is pivoted inwardly, the eyelet 6 can still be grasped by positioning the load-supporting apparatus 1 on the eyelet 6 in a horizontally offset disposition, i.e. more to the left in FIG. 2, so that the eyelet 6 is pushed into the wedge-shaped opening 17 and simply presses the hook 3 aside to pass between the hook end 8 and the centering unit 5 and ultimately into the throat area 7 of the load hook 3. After passage of the eyelet 6, the load hook 3 abuts again upon the centering unit 5. Thus, the need for placing the frame 9 against a resistance before realizing a rotation of the load hook 3 is eliminated when the load hook 3 is in the closed, i.e. load-receiving position. The opening 17 also allows, however, to operate the load-supporting apparatus 1 by conventional impact means, such as chain, rope etc.

While the invention has been illustrated and described as embodied in a load-supporting apparatus for loads having a pick-up eyelet, it is not intended to be limited to the details shown since various modifications and structural changes may be made without departing in any way from the spirit of the present invention.

What is claimed as new and desired to be protected by letters patent is set forth in the appended claims:

What is claimed is:

1. A load-supporting apparatus, comprising:

a load hook defining a throat area and swingably mounted for rotation in a vertical plane between a locked stand-by position in which the load hook is disengaged from a pick-up eyelet of a load and a locked load-receiving position in which the load hook engages the pick-up eyelet of the load; and a centering unit operatively connected to the load hook for effecting a swinging of the load hook between the stand-by and load-receiving positions when the centering unit encounters a resistance, said centering unit closing off the throat area of the load hook after swinging the load hook into the load-receiving position, said centering unit including a slide element which has a recess, said load hook having a hook end which engages the recess of the slide element when the load hook is in the load-receiving position.

2. The load-supporting apparatus of claim 1 wherein the load hook has a pointed end, said centering unit being positioned directly opposite to the pointed end for covering the pointed end when the load hook is in the load-receiving position.

3. The load-supporting apparatus of claim 1 wherein the hook end of the load hook is of pointed configuration and engages in a form-fitting manner the recess of the slide element.

4. The load-supporting apparatus of claim 1 wherein the centering unit further includes a centering frame, said slide element being supported for movement in a vertical direction and having a lower end carrying the centering frame.

5. The load-supporting apparatus of claim 1 wherein the load hook has a shank portion, and further comprising a pivot lever having one end articulated to the slide element and another end articulated to the shank portion of the load hook so that a vertical displacement of the slide element translates into a rotation of the load hook.

6. The load-supporting apparatus of claim 1 wherein the load hook has a pointed end which is urged by the own weight of the slide element into forced engagement with the slide element in the load-receiving position of the load hook.

7. The load-supporting apparatus of claim 1 wherein locking and unlocking of the load hook is controllable in dependence on a relative position of the slide element.

8. The load-supporting apparatus of claim 1 wherein the load hook swings alternately from one of the stand-by and load-receiving positions into the other one of the stand-by and load-receiving positions.

9. The load-supporting apparatus of claim 1, and further comprising a locking slotted-link mechanism for guiding the rotation of the load hook between the stand-by and load-receiving positions.

10. A load-supporting apparatus, comprising:

a housing;

a load hook defining a throat area and swingably mounted in the housing for rotation in a vertical plane between a locked stand-by position in which the load hook is disengaged from a pick-up eyelet of a load and a locked load-receiving position in which the load hook engages the pick-up eyelet of the load;

a centering unit for centering the load hook with respect to the eyelet and closing off the throat area of the load hook after the load hook is pivoted into the load-receiving position, said centering unit including a slide element having a lower end and being slidably supported in the housing for movement in a vertical direction within a track of the housing; and a guide mechanism so hingedly coupled to the centering unit and the load hook that the centering unit effects a swinging of the load hook between the stand-by and load-receiving positions when encountering a resistance.

11. The load-supporting apparatus of claim 10 wherein the load hook has a pointed end, said centering unit being positioned directly opposite to the pointed end for covering the pointed end when the load hook is in the load-receiving position.

12. The load-supporting apparatus of claim 10 wherein the centering unit has a recess, said load hook having a pointed end which engages in a form-fitting manner the recess of the centering unit when the load hook is in the load-receiving position.

13. The load-supporting apparatus of claim 10 wherein the centering unit includes a centering frame secured to the lower end of the slide element.

14. The load-supporting apparatus of claim 10 wherein the guide mechanism includes a pivot lever having one end articulated to the slide element and another end articulated to the load hook so that a vertical displacement of the slide element translates into a rotation of the load hook.

15. The load-supporting apparatus of claim 14 wherein the guide mechanism includes an endless slot for so guiding the pivot lever that the load hook swings alternately from one of the stand-by and load-receiving positions into the other one of the stand-by and load-receiving positions during reciprocating movement of the slide element in the track.

16. The load-supporting apparatus of claim 10 wherein the load hook has a hook end which is urged by the own weight of the slide element into a forced engagement with the slide element in the load-receiving position of the load hook.

* * * * *